US006488161B1

(12) United States Patent
Bean

(10) Patent No.: US 6,488,161 B1
(45) Date of Patent: Dec. 3, 2002

(54) BOOM MECHANISM

(75) Inventor: Andrew J. Bean, Greencastle, PA (US)

(73) Assignee: JLG Industries, Inc., McConnellsburg, PA (US)

( * ) Notice: Subject to any disclaimer, the term of this patent is extended or adjusted under 35 U.S.C. 154(b) by 0 days.

(21) Appl. No.: 09/562,430

(22) Filed: May 2, 2000

(51) Int. Cl.[7] ..... B66C 23/42

(52) U.S. Cl. ..... 212/300; 182/2.9; 212/238; 212/261

(58) Field of Search ..... 212/238, 261, 212/300; 182/2.7, 2.9

(56) References Cited

U.S. PATENT DOCUMENTS

| | | | | | |
|---|---|---|---|---|---|
| 3,169,602 | A | | 2/1965 | Myers | |
| 3,891,056 | A | | 6/1975 | Ashworth | |
| 3,891,264 | A | * | 6/1975 | Hunter et al. | 182/2.9 |
| 4,019,604 | A | | 4/1977 | Benson | |
| 4,053,075 | A | * | 10/1977 | Stedman | 214/270 |
| 4,226,300 | A | | 10/1980 | Rallis et al. | |
| RE31,400 | E | | 10/1983 | Rallis et al. | |
| 4,646,875 | A | * | 3/1987 | Sholl | 182/2 |
| 4,660,730 | A | | 4/1987 | Holmes | |
| 4,757,875 | A | | 7/1988 | Hade, Jr. et al. | |
| 4,770,271 | A | * | 9/1988 | Tranchero | 212/261 |
| 4,944,364 | A | | 7/1990 | Blasko | |
| 4,953,666 | A | | 9/1990 | Ridings | |
| 5,082,085 | A | | 1/1992 | Ream et al. | |
| 5,129,480 | A | | 7/1992 | Garrett et al. | |
| 5,135,074 | A | * | 8/1992 | Hornagold | 182/2 |
| 5,159,989 | A | | 11/1992 | Claxton | |
| 5,460,246 | A | | 10/1995 | Burch et al. | |
| 5,564,522 | A | | 10/1996 | Markin et al. | |
| 5,704,498 | A | | 1/1998 | Smith et al. | |
| 5,913,379 | A | * | 6/1999 | Young et al. | 182/2.7 |
| 6,024,191 | A | * | 2/2000 | Backer et al. | 182/2.7 |

* cited by examiner

*Primary Examiner*—Thomas J. Brahan
(74) *Attorney, Agent, or Firm*—Nixon & Vanderhye P.C.

(57) ABSTRACT

A boom mechanism that is cooperable with a lift vehicle or base structure includes a tower boom and an upper boom liftable in a dependent relationship by a single lifting mechanism. The tower boom and the upper boom are respectively pivotally secured to an upright having a fixed orientation by a tower link or the like. A timing link is secured between the tower boom and the upper boom, and a lifting mechanism is secured between the upright and the upper boom. As the upper boom is driven by the lifting mechanism, the timing link secured to the tower boom causes the tower boom to pivot about a tower boom nose pivot, thereby raising both the upper boom and the tower boom in a dependent relationship. The construction helps to minimize the need for tail and frame counterweight by controlling a position of the platform in configurations of both forward and rearward instability. As a consequence, the gross vehicle weight can be considerably reduced.

25 Claims, 7 Drawing Sheets

BOOM MECHANISM

BACKGROUND OF THE INVENTION

The present invention relates to a boom mechanism cooperable with a lift vehicle or base structure and, more particularly, to a boom mechanism including two pivoting boom members liftable in a dependent relationship by a single lifting mechanism.

A conventional straight boom lift typically includes a single telescopic boom by which the platform can be positioned from low angles (usually below horizontal) to high angles (such as around 75° above horizontal). Boom angles near horizontal create a situation of forward instability in which the machine may tend to tip toward the platform due to the overhung load created by the platform load and boom assembly. Counterweight is usually added to the tail of the vehicle turntable to counterbalance the destabilizing moment created by the boom and platform load.

Maximum boom angles, on the other hand, tend to create a situation of backward instability in which the weight of the boom and the counterweight in the tail of the turntable tend to cause the machine to tip in the direction opposite the platform. A counterweight added to the frame of the machine helps to counterbalance the destabilizing moment caused by the boom and tail counterweight. The total weight of the machine is then dependent on the compromise made for the placement of weight required to satisfy both conditions of instability.

A conventional single tower articulated boom lift typically includes two booms connected by an upright. The upright is held in a vertical (plumb) orientation as the lower boom or tower is raised in angle. Maintaining the upright in its vertical orientation is usually achieved by a master and slave hydraulic circuit or a parallelogram linkage with the tower boom. The upper boom is typically pinned to the upright with its own lift cylinder, which can be raised or lowered in angle through its full range of motion regardless of the position of the tower boom. As a consequence, the two booms can be independently positioned to allow the machine to be "articulated" into work positions or positioned up and over obstacles. The total maximum height of the platform is achieved by the contribution of the tower and the upper boom lengths. Each boom is typically shorter than the boom of a comparable height straight boom lift; therefore, the maximum horizontal outreach provided by the upper boom is typically less than the single boom of a comparable height straight boom lift.

A position of maximum forward instability for this type of boom lift is encountered when the tower is raised to its full angle with the upper boom near the horizontal angle. This position creates the maximum horizontal outreach of the platform as well as positioning the boom structure weight in the most detrimental position to the forward stability of the machine. Just as in the straight boom designs, counterweight is added to the tail of the turntable to counterbalance the destabilizing moment of the upper boom and the platform load.

A position of maximum backward instability for an articulated boom lift occurs when the tower is lowered to a near horizontal angle while the upper boom is raised to its maximum angle. In this position, the weight of the boom structure has moved to the most detrimental position to the backward stability of the machine. As in the case of the straight boom lifts, the backward instability is made worse by the presence of the tail counterweight added to reduce forward instability. Consequently, similar to the straight boom design, frame counterweight is added to counterbalance the destabilizing moment caused by the boom and tail counterweight.

SUMMARY OF THE INVENTION

The boom mechanism according to the present invention does not fall into the category of a straight boom lift or an articulated boom lift. That is, the construction according to the invention is not a straight boom lift as it incorporates the tower boom, upright and upper boom found on a single tower articulated boom lift. Additionally, the construction according to the invention is not an articulated boom lift as the booms cannot be independently positioned with respect to each other. The arrangement incorporates a linkage that mechanically ties the tower boom and the upper boom to each other allowing one lift cylinder to lift the entire boom structure. Thus, one boom cannot be raised without the other also being raised, creating forward and backward instability characteristics that greatly differ from the conventional straight or articulated boom lifts.

A condition of maximum forward instability with the construction according to the invention is forced to occur when the tower is near horizontal rather than at its full angle as in the conventional articulated boom lift. See FIG. 6—the arrow indicating the direction of instability. This construction reduces the horizontal outreach of the upper boom and therefore the degree of destabilizing moment of the upper boom and the platform load. It also allows the weight of the boom structure to be in the most favorable position to aid in the counterbalancing of the upper boom and platform load destabilizing moment. Both of these factors result in less tail counterweight required to counterbalance the boom and platform.

The condition of maximum backward instability for the conventional articulated boom is eliminated (i.e., when the tower is down while the upper boom is at its maximum angle). With the present construction, a position of maximum backward instability occurs when the upper boom is fully raised and, by default, when the tower is fully raised. See FIG. 7—the arrow indicating the direction of instability. This puts the weight of the boom structure in the best possible position to aid in counterbalancing the destabilizing moment caused by the boom and the already reduced weight tail counterweight. The result is a dramatic reduction in the need for counterweight in the frame.

In accordance with an exemplary embodiment of the invention, a boom mechanism cooperable with a lift vehicle or base structure includes a tower boom pivotally securable at a base end to the lift vehicle or base structure. An upright pivotally secures an upright end of the tower boom. An upper boom is pivotally secured at one end to the upright, and a timing link is connected between the upper boom and the tower boom. A lift cylinder is connected between the upright and the upper boom. The upright may have a fixed orientation relative to the vehicle or base structure. In this context, the boom mechanism may also include a tower link pivotally attached at one end to the lift vehicle or base structure and pivotally attached at an opposite end to the upright, wherein the tower link fixes the orientation of the upright relative to the lift vehicle or base structure. The upright end of the tower boom may be secured to the upright at a tower boom nose pivot, wherein the timing link is secured to the tower boom at a position spaced from the tower boom nose pivot such that the timing link generates a moment about the tower boom nose pivot.

The upper boom is preferably pivotally secured to the upright at an upper boom pivot, wherein an extension axis of the lift cylinder is spaced from the upper boom pivot such that the lift cylinder generates a moment about the upper boom pivot. The timing link is preferably secured to the upper boom at a position spaced from the upper boom pivot such that a linking force is generated in the timing link as the upper boom is pivoted about the upper boom pivot. The space between the timing link and the tower boom nose pivot may be larger than the space between the timing link and the upper boom pivot, thereby creating a mechanical advantage to assist in lifting the tower.

The timing link is preferably secured to the upper boom in a position that effects displacement in one direction relative to an orientation of the timing link at low angles with a component in a substantially perpendicular direction that increases with increasing extension of the lift cylinder. On the other hand, the timing link is preferably secured to the tower boom in a position that effects displacement in the substantially perpendicular direction relative to the orientation of the timing link at low angles. In a preferred arrangement, the lift cylinder is the only motive force of the boom mechanism.

In another exemplary embodiment of the invention, a lift vehicle includes a vehicle chassis supporting a plurality of wheels, a drive system operable for driving the wheels, a base structure supported by the vehicle chassis, and the boom mechanism according to the invention secured to the base structure.

In accordance with yet another exemplary embodiment of the invention, a boom mechanism includes a tower boom and an upper boom liftable in a dependent relationship by a single lifting mechanism. The tower boom and the upper boom are respectively pivotally secured to an upright. A timing link is secured between the tower boom and the upper boom, and the lifting mechanism is secured between the upright and the upper boom.

In accordance with still another exemplary embodiment of the invention, a method of constructing a boom mechanism cooperable with a lift vehicle or base structure includes the steps of providing a tower boom pivotally securable at a base end to the lift vehicle or base structure, pivotally securing an upright end of the tower boom to an upright, pivotally securing an upper boom at one end to the upright, connecting a timing link between the upper boom and the tower boom, and connecting a lift cylinder between the upright and the upper boom.

In accordance with another exemplary embodiment, a boom mechanism includes a tower boom and an upper boom liftable in a dependent relationship by a single lifting mechanism, with the tower boom and the upper boom being respectively pivotally secured to an upright. A timing link is secured between the tower boom and the upper boom, and the tower boom is shorter than the upper boom. The tower boom and the upper boom are preferably the only booms of the boom mechanism. The upper boom may be a telescopic boom.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
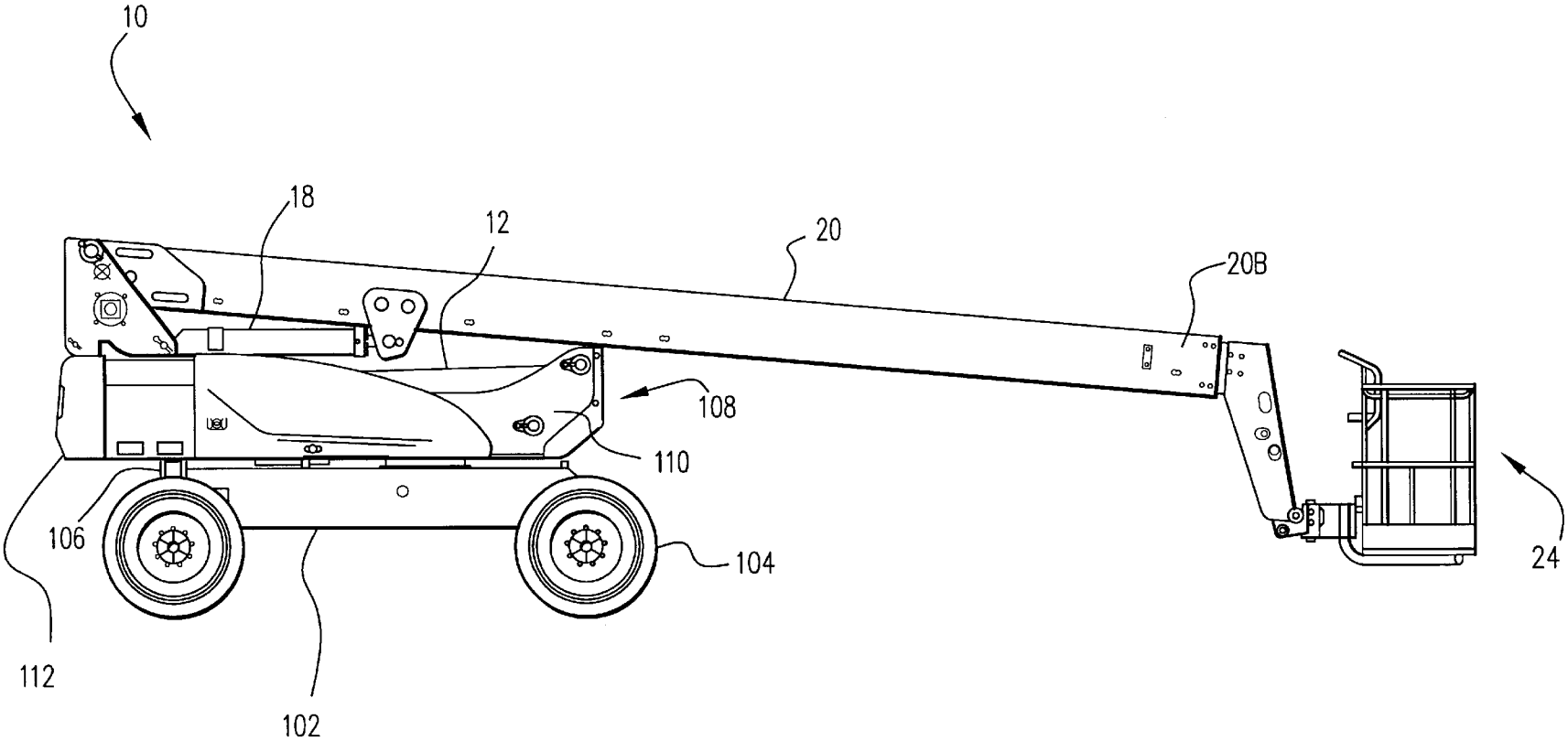
FIG. 1 is a side view of a lift vehicle incorporating the boom mechanism of the present invention.

FIG. 1 shows a lift vehicle incorporating the boom mechanism 10 according to the present invention. The vehicle generally includes a frame or chassis 102 that supports a plurality of wheels 104. A drive system 106 is operable for driving the wheels 104. The controlling mechanism for the drive system 106 is conventional, and the details thereof will not be further described. This controlling mechanism can be configured in a vehicle cab (not shown) or at the platform of the boom assembly or both. A supporting base structure 108 including a turntable 110 and a tail counterweight 112 is supported by the vehicle chassis 102.

Figure 2:
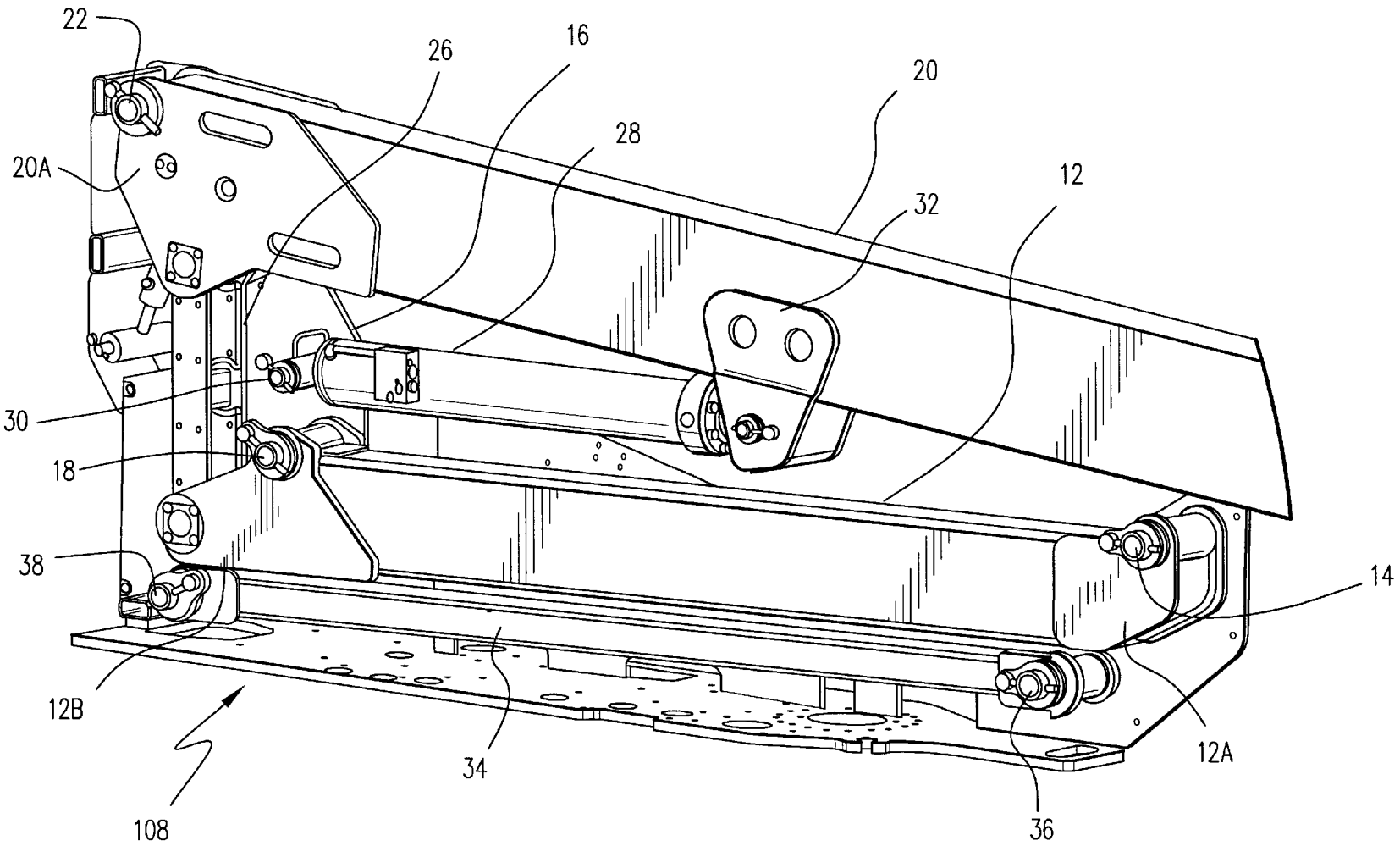
FIG. 2 is a perspective view of the boom mechanism with portions of the turntable removed for ease of understanding.
Figure 3:
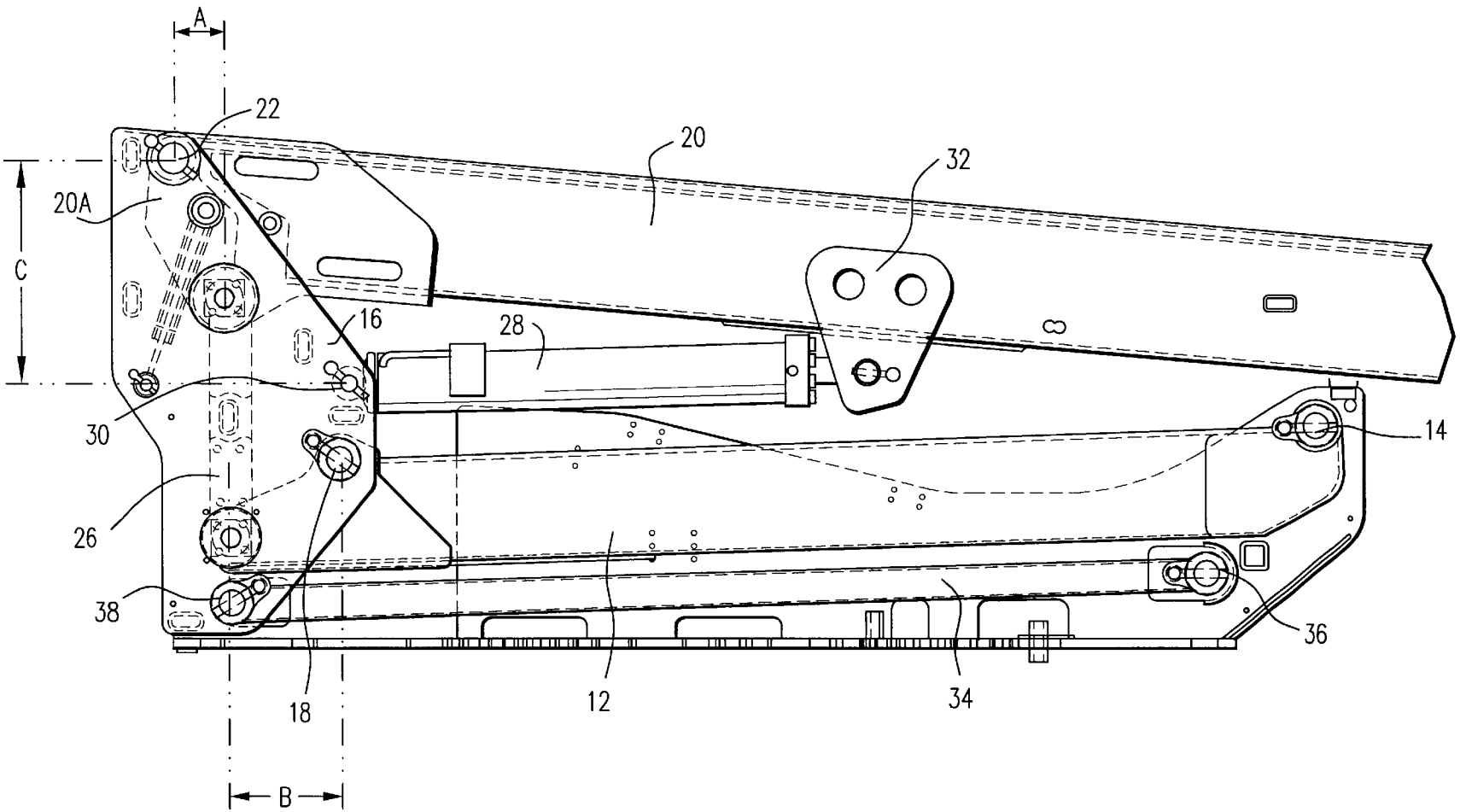
FIG. 3 is a side view of the boom mechanism in the stowed position.
Figure 7:
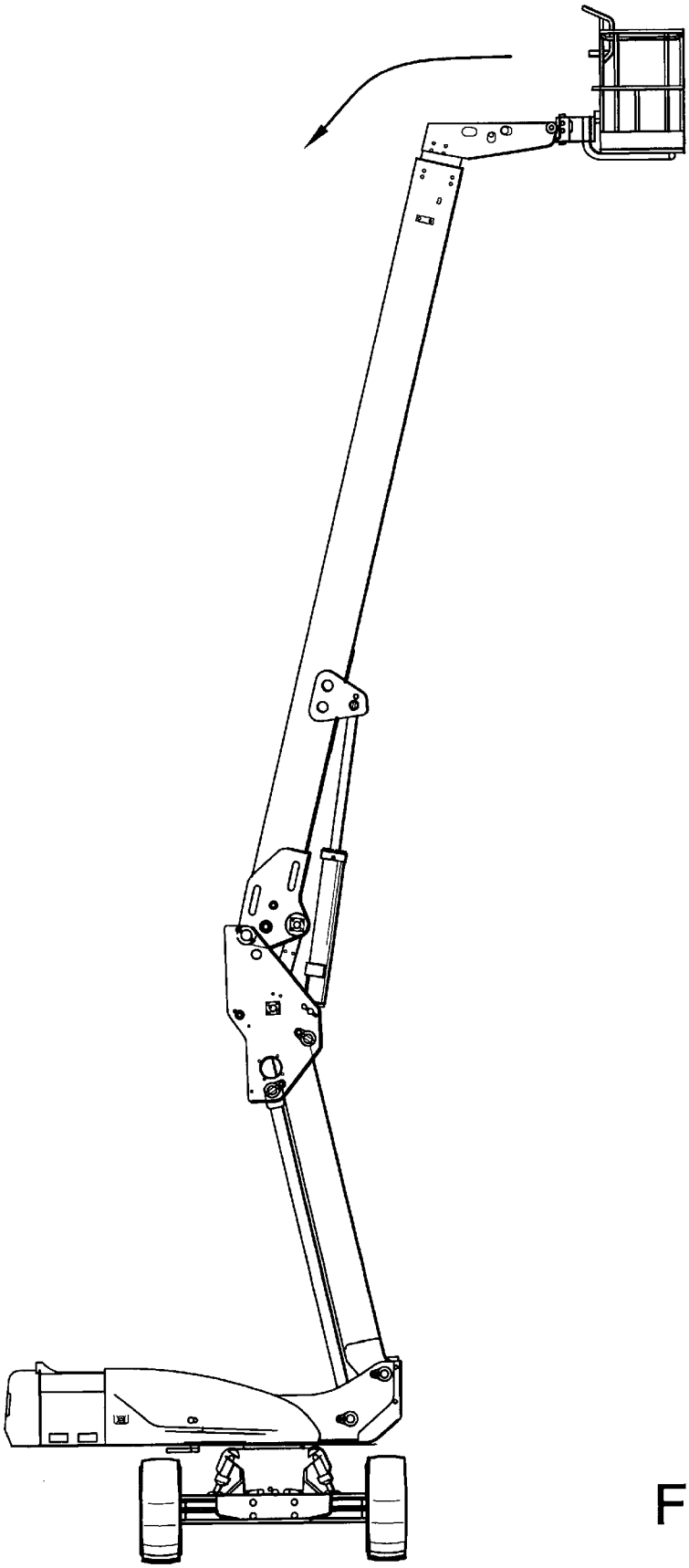
FIG. 7 illustrates a position of least backward stability.

With reference to FIGS. 1–3, the boom mechanism 10 according to the present invention is shown cooperable with the vehicle supporting base structure 108. The boom mechanism 10 includes a tower boom 12 that is pivotally secured to the supporting base structure 108 at a base end 12A via a base pivot 14. The tower boom 12 is pinned to the turntable 110 via the base pivot 14, which can be of any suitable construction. An upright end 12B of the tower boom 12 is pivotally secured to an upright 16 at a tower boom nose pivot 18. The boom mechanism 10 also includes an upper boom 20 that is pivotally secured at its base end 20A to the upright 16 via an upper boom pivot 22. Preferably, the tower boom 12 is shorter than the upper boom 20 (as shown in FIGS. 1 and 7), and the upper boom 20 is telescopic to maximize use and functionality of the apparatus. The construction of the telescopic boom is conventional and will not be further described.

As shown in FIG. 1, an extending end 20B of the upper boom 20 supports a platform assembly 24. A timing link 26 is connected between the tower boom 12 and the upper boom 20 at the upright end 12B of the tower boom 12 and the base end 20A of the upper boom 20. A lift cylinder 28 or like lifting mechanism is preferably secured between the upright 16 and the upper boom 20 via a lift pivot 30 and a lift attaching frame 32, respectively. The lift cylinder 28 is pinned to the upright 16 via the lift pivot 30 of any suitable construction, and the lift attaching frame 32 may be secured to the upper boom 20 by welding or the like. In alternative constructions, the lift cylinder 28 may be connected between the supporting structure 108 and the tower boom 12, between the tower boom 12 and the upright 16, between the tower boom 12 and a tower link 34 (e.g., at opposite corners of the parallelogram), or between the tower boom 12 and the upper boom 20, with various effects on load support (discussed in more detail below).

The tower link 34 serves to fix the orientation of the upright 16 relative to the base structure 108. The tower link 34 is pivotally attached at one end to the base structure via a tower link pivot 36 and at an opposite end to the upright 16 via a pivot 38.

Lifting of the boom mechanism 10 will be described with reference to FIGS. 3–5. Lifting of the boom mechanism 10 is accomplished by creating angular motion of the upper boom 20 (counterclockwise in FIG. 3) relative to the upright 16 about the upper boom pivot 22, thereby creating angular motion of the tower boom 12 about the tower boom nose pivot 18. The upper boom 20 angular motion is generated by extending the lift cylinder 28. As the lift cylinder 28 is extended, the lift cylinder generates a moment about the upper boom pivot 22 by virtue of a distance C between an extension axis of the lift cylinder 28 and the upper boom pivot 22.

The tower boom 12 motion is generated by the movement of the upper boom 20 causing a displacement of the timing link 26 relative to the upright 16. As seen in FIG. 3, the timing link 26 is secured to the upper boom 20 at a position spaced from the upper boom pivot 22 by a distance A such that a linking force is generated in the timing link 26 as the upper boom 20 is pivoted about the upper boom pivot 22. The upper boom pivot moment is the sum of the moments generated by the upper boom mass and the force on the timing link 26 acting on dimension A. With respect to the tower boom 12, the timing link 26 is secured to the tower boom 12 at a position spaced from the tower boom nose pivot 18 via space B such that the timing link 26 generates a moment about the tower boom nose pivot 18. Thus, the force in the timing link is a function of dimension B.

In the stowed position, the moment required to lift the upper boom 20 alone is nearly maximum as the boom is nearly horizontal. Similarly, the moment about the tower boom nose pivot 18 is nearly maximum as the tower boom 12 is nearly horizontal. In this configuration, the position of the timing link is set to reduce the combined magnitude of lifting both the upper boom 20 and the tower boom 12 at the same time. Preferably, dimension B is about 2.5 times larger than dimension A or more, resulting in a mechanical advantage up to 2.5:1 or higher in reducing the force to lift the tower boom 12. This mechanical advantage diminishes as the upper boom 20 is raised, however, dimension C becomes larger (to a point) by virtue of the pivoting of the lift cylinder 28, allowing the lift cylinder 28 to better react to the increased loads required to lift the tower boom 12. As the upper boom 20 is raised farther, the dimension C becomes less again, but the angles of the two booms induce less load as well.

The positioning of the timing link 26 also has an advantage in the forward stability of the machine, particularly on a forward slope. In the stowed position, the upper boom 20 is below horizontal. As the upper boom 20 is raised, it causes the platform 24 to gain outward reach (until it goes beyond the horizontal position) and therefore increases the forward destabilizing moment. As the tower boom 12 is raised above horizontal, it also pushes the upper boom 20 farther into the forward instability position.

To minimize this effect, the timing link 26 is positioned on the upper boom 20 to effect faster rotation of the upper boom 20 relative to the tower boom 12 at low angles. That is, with continued reference to FIG. 3, the timing link 26 is secured to the upper boom 20 in a position that effects substantial horizontal displacement relative to the orientation of the timing link 26 at low angles with a vertical component that increases with increasing extension of the lift cylinder 28 (see FIGS. 3, 4 and 5). In contrast, the timing link 26 is secured to the tower boom 12 in a position that effects substantially vertical displacement relative to the orientation of the timing link 26 at low angles (FIGS. 3–5). This advantageous effect can be achieved using any vector differentiation relative to the orientation of the timing link 26. This construction minimizes the extent that the upper boom 20 is positioned into positions of forward instability.

An important purpose of the lift cylinder 28 is to create motion. The timing link 26 transfers this motion to the rest of the configuration. As noted, the lift cylinder 28 is preferably secured between the upright 16 and the upper boom 20. Although functionally feasible, if the lift cylinder 28 was mounted between the turntable 110 and the tower boom 12, between the tower boom 12 and the upright 16, or between the tower boom 12 and the tower link 34, the timing link 26 would be required to push the upper boom 20 up as the tower 12 is raised. Consequently, the forces in the link 26 would be considerably higher, and the timing link 26 would not support the upper boom 20 as far toward the platform 24 as the preferred placement of the lift cylinder 28. The length of the upper boom 20 from the platform 24 to a supporting point would be longer, resulting in increased deflection of the upper boom 20. If, on the other hand, the lift cylinder 28 was mounted between the upper boom 20 and the tower boom 12, although still functionally feasible, the loads in the tower boom nose pivot 18 would be higher, and the extended length of the lift cylinder 28 would have to be longer. This is due to the motion of the tower boom 12 moving down relative to the upper boom 20 as the structure is lifted.

The tower link 34 creates a four-bar linkage or parallelogram with the tower boom. The link 34 forces the upright 16 to remain level (plumb) while the tower boom 12 raises in angle and reacts to the moment of the upper boom 20 effectively removing the position of the upper boom 20 from influencing the loads required to lift the tower boom 12. Leveling of the upright 16 could also be accomplished with a master/slave arrangement between the turntable 110 and the upright 16 in lieu of the use of the tower link 34. The master/slave arrangement would enable the tower boom 12 to also be telescopic. Alternatively, the upright 16 need not have a fixed orientation, but a master/slave arrangement for platform leveling could not be implemented. In this case, a feedback leveling system could be implemented.

Figure 4:
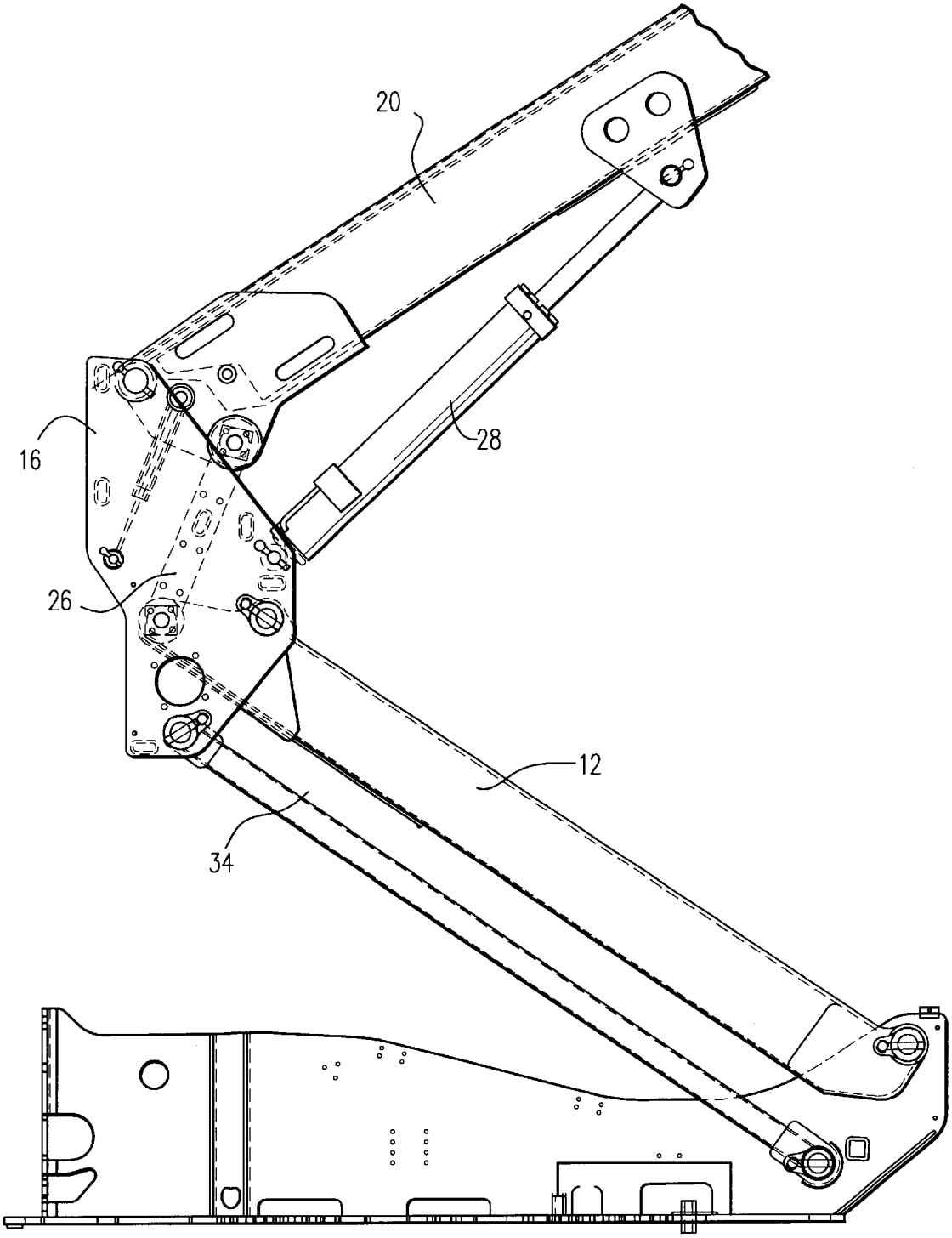
FIG. 4 is a side view of the boom mechanism in a mid-position.
Figure 5:
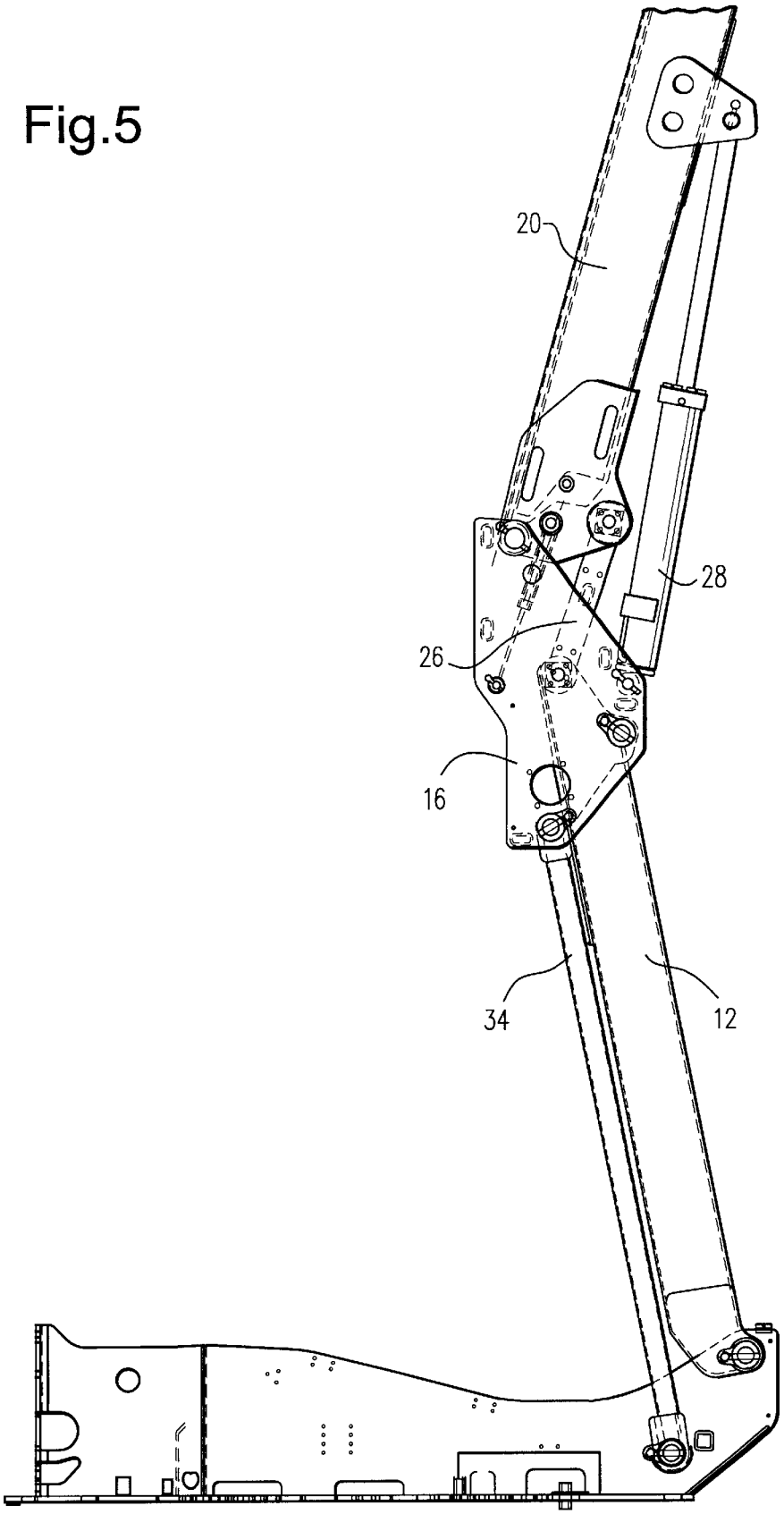
FIG. 5 is a side view of the boom mechanism in a fully raised position.
Figure 6:
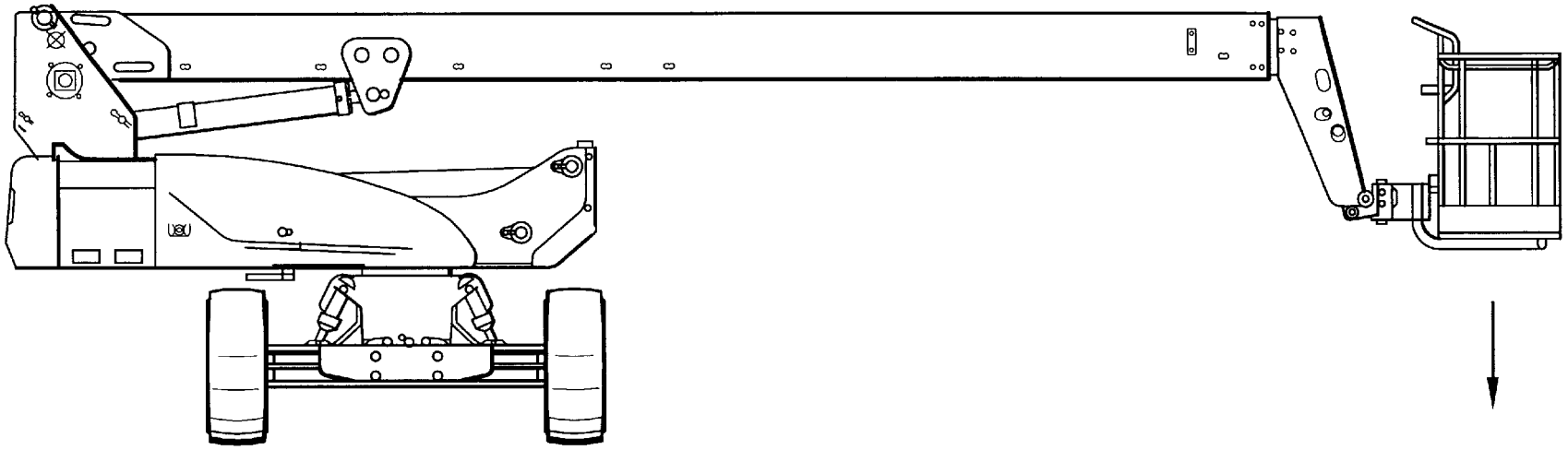
FIG. 6 illustrates a position of least forward stability.

As seen in FIGS. 4 and 5, the tower boom 12 has several functions. Primarily, its angular change increases the maximum working height of the platform 24. When the structure is lowered, the length of the tower boom 12 positions the upper boom 20 (and the mass of the entire boom structure) away from the position of maximum forward instability. See FIG. 6—the arrow indicating the direction of instability. When the structure is up, the tower boom 12 positions the upper boom 20 (and the mass of the entire boom structure) away from the position of maximum backward instability. See FIG. 7—the arrow indicating the direction of instability. A change in tower boom angle helps to compensate for the change in upper boom angle, reducing the amount of horizontal movement of the platform during boom movements. This construction creates more comfortable motion for the operator and reduces the amount of repositioning of the platform required for jobs requiring vertical travel.

The upright remains level (plumb) during changes in the tower boom angle via the tower link 34. As a result, the upright reduces the total stroke of the lift cylinder 28 as the angle change between the upright 16 and the upper boom 20 is only a portion of the angle change between the upright 16 and the tower boom 12. The upright 16 is a fixed orientation member of the mechanism allowing the timing link 26 to create motion around the tower boom nose pivot 18.

With the construction according to the present invention, the dependency of the tower and upper boom not only limits the magnitude of the horizontal outreach (reducing the need for tail counterweight), but also improves both conditions of forward and backward instability. The boom structure's own weight is used as counterweight to assist in counterbalancing the destabilizing moments of both conditions. The result is a machine with a remarkably low gross vehicle weight. For example, one of the lightest 60-foot platform height boom lifts presently available weighs about 21,000 pounds, whereas with the construction according to the present invention, the lift weighs about 14,900 pounds. As a consequence, the lower gross vehicle weight has many benefits including smaller, lighter and less expensive components; lighter ground contact pressures of the tires for better floatation on soft terrain as well as reduced interior floor loading; increased battery performance and/or fuel efficiency; and ease of shipping.

The dependency of the tower to the upper boom also has the benefit of reducing the complexity of operation. This configuration has only one cylinder to raise the entire boom structure, as is the case of the straight boom lift. Conventional articulated machines have one cylinder to raise the tower boom and another cylinder to raise the upper boom. Fewer controls result in less operator training, potentially less maintenance, and easier use.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A boom mechanism cooperable with a lift vehicle or base structure, the boom mechanism comprising:

a tower boom pivotally securable at a base end to the lift vehicle or base structure;

an upright pivotally supporting an upright end of the tower boom;

an upper boom pivotally secured at one end to the upright;

a timing link connected directly between the upper boom and the tower boom; and a lift cylinder connected between the upright and the upper boom.

2. A boom mechanism according to claim 1, wherein the upright has a fixed orientation relative to the vehicle or base structure.

3. A boom mechanism according to claim 2, further comprising a tower link pivotally attachable at one end to the lift vehicle or base structure and pivotally attached at an opposite end to the upright, the tower link fixing the orientation of the upright relative to the lift vehicle or base structure.

4. A boom mechanism according to claim 1, wherein the upright end of the tower boom is secured to the upright at a tower boom nose pivot, and wherein the timing link is secured to the tower boom at a position spaced from the tower boom nose pivot such that the timing link generates a moment about the tower boom nose pivot.

5. A boom mechanism according to claim 1, wherein the upper boom is pivotally secured to the upright at an upper boom pivot, and wherein an extension axis of the lift cylinder is spaced from the upper boom pivot such that the lift cylinder generates a moment about the upper boom pivot.

6. A boom mechanism according to claim 5, wherein the timing link is secured to the upper boom at a position spaced from the upper boom pivot such that a linking force is generated in the timing link as the upper boom is pivoted about the upper boom pivot.

7. A boom mechanism according to claim 6, wherein the upright end of the tower boom is secured to the upright at a tower boom nose pivot, and wherein the timing link is secured to the tower boom at a position spaced from the tower boom nose pivot such that the timing link generates a moment about the tower boom nose pivot.

8. A boom mechanism according to claim 7, wherein the space between the position at which the timing link is secured to the tower boom and the tower boom nose pivot is larger than the space between the position at which the timing link is secured to the upper boom and the upper boom pivot, thereby creating a mechanical advantage.

9. A boom mechanism according to claim 8, wherein the space between the timing link and the tower boom nose pivot is configured such that the mechanical advantage is up to 2.5:1.

10. A boom mechanism according to claim 1, wherein the timing link is secured to the upper boom in a position that effects displacement in one direction relative to an orientation of the timing link at low angles with a component in a substantially perpendicular direction that increases with increasing extension of the lift cylinder, and wherein the timing link is secured to the tower boom in a position that effects displacement in the substantially perpendicular direction relative to the orientation of the timing link at low angles.

11. A boom mechanism according to claim 1, wherein the lift cylinder is the only motive force of the boom mechanism.

12. A lift vehicle comprising:

a vehicle chassis supporting a plurality of wheels;

a drive system operable for driving the wheels;

a base structure supported by the vehicle chassis; and a boom mechanism, including:

a tower boom pivotally secured at a base end to the base structure, an upright pivotally supporting an upright end of the tower boom, an upper boom pivotally secured at one end to the upright, a timing link connected directly between the upper boom and the tower boom, and a lift cylinder connected between the upright and the upper boom.

13. A lift vehicle according to claim 12, wherein the upright has a fixed orientation relative to the vehicle or base structure.

14. A lift vehicle according to claim 13, wherein the boom mechanism further comprises a tower link pivotally attached at one end to the base structure and pivotally attached at an opposite end to the upright, the tower link fixing the orientation of the upright relative to the base structure.

15. A boom mechanism comprising a tower boom and an upper boom liftable in a dependent relationship by a single lifting mechanism, the tower boom and the upper boom being respectively pivotally secured to an upright, wherein a timing link is secured directly between the tower boom and the upper boom, and wherein the lifting mechanism is secured between the upright and the upper boom.

16. A boom mechanism according to claim 15, further comprising a tower link pivotally attached to the upright that fixes the orientation of the upright.

17. A boom mechanism according to claim 15, wherein an upright end of the tower boom is secured to the upright at a tower boom nose pivot, and wherein the timing link is secured to the tower boom at a position spaced from the tower boom nose pivot such that the timing link generates a moment about the tower boom nose pivot.

18. A boom mechanism according to claim 15, wherein the upper boom is pivotally secured to the upright at an upper boom pivot, and wherein an acting axis of the lifting mechanism is spaced from the upper boom pivot such that the lifting mechanism generates a moment about the upper boom pivot.

19. A boom mechanism according to claim 18, wherein the timing link is secured to the upper boom at a position spaced from the upper boom pivot such that a linking force is generated in the timing link as the upper boom is pivoted about the upper boom pivot.

20. A boom mechanism according to claim 19, wherein an upright end of the tower boom is secured to the upright at a tower boom nose pivot, and wherein the timing link is secured to the tower boom at a position spaced from the tower boom nose pivot such that the timing link generates a moment about the tower boom nose pivot.

21. A boom mechanism according to claim 20, wherein the space between the position at which the timing link is secured to the tower boom and the tower boom nose pivot is larger than the space between the position at which the timing link is secured to the upper boom and the upper boom pivot, thereby creating a mechanical advantage.

22. A boom mechanism according to claim 21, wherein the space between the timing link and the tower boom nose pivot is configured such that the mechanical advantage is up to 2.5:1.

23. A boom mechanism according to claim 15, wherein the timing link is secured to the upper boom in a position that effects displacement in one direction relative to an orientation of the timing link at low angles with a component in a substantially perpendicular direction that increases with increasing extension of the lift cylinder, and wherein the timing link is secured to the tower boom in a position that effects displacement in the substantially perpendicular direction relative to the orientation of the timing link at low angles.

24. A boom mechanism comprising a tower boom and an upper boom liftable in a dependent relationship by a single lifting mechanism secured at one end to the upper boom, the tower boom and the upper boom being respectively pivotally secured to an upright, wherein a timing link is secured directly between the tower boom and the upper boom, wherein the tower boom is shorter than the upper boom, and wherein the tower boom and the upper boom are the only booms of the boom mechanism.

25. A boom mechanism according to claim 24, wherein the upper boom is a telescopic boom.

* * * * *